US010411323B2

(12) United States Patent
Fehrenbach et al.

(10) Patent No.: US 10,411,323 B2
(45) Date of Patent: Sep. 10, 2019

(54) ANTENNA ARRANGEMENT

(71) Applicant: VEGA GRIESHABER KG, Wolfach (DE)

(72) Inventors: Josef Fehrenbach, Haslach (DE); Daniel Schultheiss, Hornberg (DE); Fritz Lenk, Schiltach (DE); Klaus Kienzle, Zell a.H (DE); Jürgen Motzer, Gengenbach (DE); Thomas Deck, Wolfach (DE); Johannes Falk, St. Georgen (DE); Jürgen Skowaisa, Schiltach (DE); Clemens Hengstler, Haslach (DE)

(73) Assignee: Vega Grieshaber KG, Wolfach (DE)

( * ) Notice: Subject to any disclaimer, the term of this patent is extended or adjusted under 35 U.S.C. 154(b) by 0 days.

(21) Appl. No.: 15/300,151

(22) PCT Filed: May 30, 2014

(86) PCT No.: PCT/EP2014/061270
§ 371 (c)(1),
(2) Date: Sep. 28, 2016

(87) PCT Pub. No.: WO2015/180794
PCT Pub. Date: Dec. 3, 2015

(65) Prior Publication Data

US 2017/0162928 A1 Jun. 8, 2017

(51) Int. Cl.
*H01Q 1/12* (2006.01)
*H01Q 1/22* (2006.01)
*H01Q 21/00* (2006.01)

(52) U.S. Cl.
CPC ..... *H01Q 1/1221* (2013.01); *H01Q 1/125* (2013.01); *H01Q 1/1214* (2013.01); *H01Q 1/225* (2013.01); *H01Q 21/00* (2013.01)

(58) Field of Classification Search
CPC ..... H01Q 1/1221; H01Q 21/00; H01Q 1/125; H01Q 1/225
See application file for complete search history.

(56) References Cited

U.S. PATENT DOCUMENTS 3,241,144 A 3/1966 Berger
4,037,229 A * 7/1977 Dunk ..... H01Q 1/3258 248/288.31

(Continued)

FOREIGN PATENT DOCUMENTS

CN 202 453 0838 U 2/2012
CN 202 511 842 U 10/2012

(Continued)

OTHER PUBLICATIONS

International Search Report for related application PCT/EP2014/061270, dated Feb. 2, 2015.

(Continued)

*Primary Examiner* — Hai V Tran
*Assistant Examiner* — Michael M Bouizza
(74) *Attorney, Agent, or Firm* — William Gray Mitchell

(57) ABSTRACT

An antenna arrangement for a measuring device, having an antenna with an emission surface, and an antenna holder for pivotably fastening the antenna to a fastening apparatus for the purpose of arranging the antenna arrangement on a container or another fastening possibility, for example via a material heap, wherein the antenna holder is connected to the fastening apparatus by means of a clamping arrangement, wherein the antenna holder is in the form of a spherical layer of a sphere wherein the spherical layer has top and bottom surfaces running parallel to one another, and contains the center of the sphere, and the emission surface is arranged inside the spherical layer.

12 Claims, 2 Drawing Sheets

(56) References Cited

U.S. PATENT DOCUMENTS

| | | | | |
|---|---|---|---|---|
| 2006/0005621 | A1 | 1/2006 | Lenk | |
| 2007/0115196 | A1* | 5/2007 | Motzer | H01Q 1/225 343/786 |
| 2008/0100501 | A1 | 5/2008 | Edvardsson | |
| 2008/0272979 | A1* | 11/2008 | Kupek | H01Q 1/084 343/888 |
| 2013/0220011 | A1* | 8/2013 | Baer | H01Q 1/225 73/290 V |

FOREIGN PATENT DOCUMENTS

| | | | |
|---|---|---|---|
| DE | 10 2007 061571 | A1 | 7/2009 |
| DE | 10 2009 000733 | A1 | 8/2010 |
| DE | 102009000733 | A | 8/2010 |
| EP | 1615007 | A | 1/2006 |
| GB | 1 008 492 | A | 10/1965 |
| WO | WO 2007/042324 | A1 | 4/2007 |

OTHER PUBLICATIONS

Office Action for related Chinese application 2014 8007 9215.5, issued by SIPO dated Sep. 5, 2018.
Office Action for related Chinese application 2014 8007 9215.5, issued by SIPO dated Apr. 3, 2019.
Office Action for related Taiwanese application 104116911, issued by Taiwanese Patent Office dated Apr. 16, 109.

* cited by examiner

ANTENNA ARRANGEMENT

CROSS REFERENCE TO RELATED APPLICATIONS

This patent application claims priority to International Patent Application PCT/EP2014/061270, filed on May 30, 2014.

STATEMENT REGARDING FEDERALLY SPONSORED RESEARCH OR DEVELOPMENT

No federal government funds were used in researching or developing this invention.

NAMES OF PARTIES TO A JOINT RESEARCH AGREEMENT

Not applicable.

SEQUENCE LISTING INCLUDED AND INCORPORATED BY REFERENCE HEREIN

Not applicable.

BACKGROUND

Field of the Invention

The invention relates to an antenna arrangement.

Background of the Invention

Various antenna arrangements for measuring devices are known from prior art comprising an antenna, a front edge of an antenna, an antenna fastening for the pivotal fastening of the antenna at a fastening apparatus for arranging the antenna arrangement at a container, with the antenna fastening being connected via a clamping arrangement to the fastening apparatus. Such arrangements are known for example from EP 1 615 007 B1 of the applicant.

Measuring devices for determining a fill level or a limit of a medium in a container are known from prior art. Such an antenna arrangement, allowing a pivotal fastening of a measuring device at a container, is disclosed in the above-mentioned patent publication of the applicant. Additionally, various other touch-free operating fill level measuring devices are available which are based for example on the ultrasound principle and/or the radar principle and/or the microwave principle. Respective fill level measuring devices are assembled in a container lid or above a maximally expected fill level of the medium in the container and inside the container they send measuring signals in the direction of the medium. At a surface of the medium these measuring signals are reflected to the measuring device and detected thereby. From the traveling period of the reflected measuring signals, a fill level of the medium inside the container can then be determined.

Additionally, according to prior art, limit measuring devices are known which are assembled at the height of a fill level to be detected and detect when said fill level is exceeded.

Particularly when detecting fill levels or fill limits of bulk goods, it is necessary that the emitted measuring signals are directed, for example, to the maximum height of the cone of bulk goods or to the minimum height of the draining cone.

It may also be necessary for the radiation to bypass installations inside the container. For this purpose it is necessary to pivot the device.

In antenna arrangements of the applicant known from prior art here a so-called ball socket is used, which is arranged in the proximity of the wave adapter at a hollow conductor for coupling a measuring signal in a parabolic antenna.

The arrangement known from prior art is considered disadvantageous in that here the antenna projects far into the interior of the container and thus, in case of an adjustment of the alignment of the antenna, it requires a wide pivotal range inside the container. In particular in the case of an arrangement of the antenna in tubes or sockets, this aggravates the use of such antennas or renders their use impossible.

The objective of the present invention is to further develop an antenna arrangement known from prior art that has solved these problems.

This objective and advantageous further developments are attained in an antenna arrangement showing the features as disclosed herein.

BRIEF SUMMARY OF THE INVENTION

In a preferred embodiment, an antenna arrangement (1) for a measuring device comprising an antenna (3), with an emission surface (5), an antenna fastening (7) for the pivotal fastening of the antenna at a fastening apparatus (9), with the antenna fastening (7) being connected via a clamping arrangement (11) to the fastening apparatus (9), characterized in that the antenna fastening (7) is embodied as a spherical layer of a sphere, with the spherical layer comprising top surfaces and bottom surfaces (71, 71) extending parallel in reference to each other, comprising the central point (M) of the sphere, and the emission surface (5) being arranged inside the spherical layer.

In another preferred opinion, the antenna arrangement (1) as described herein, characterized in that the clamping arrangement (11) is formed by the fastening apparatus (9) and a clamping flange (13).

In another preferred opinion, the antenna arrangement (1) as described herein, characterized in that the fastening apparatus (9) comprises a first recess for the antenna fastening (7), with its interior surface being embodied at least sectionally in a conical fashion or showing the form of segments of a sphere.

In another preferred opinion, the antenna arrangement (1) as described herein, characterized in that the clamping flange (13) comprises a second recess, with its interior surface being embodied at least sectionally in a conical fashion or as a segment of a sphere.

In another preferred opinion, the antenna arrangement (1) as described herein, characterized in that the antenna fastening (7) comprises a limiting stop (16) for limiting a maximum pivotal angle (a).

In another preferred opinion, the antenna arrangement (1) as described herein, characterized in that the limiting stop (16) is embodied as a brace extending preferably in the radial direction of the sphere.

In another preferred opinion, the antenna arrangement (1) as described herein, characterized in that the maximum pivotal angle (a) amounts to 25°, preferably 15°, further preferably 10°.

In another preferred opinion, the antenna arrangement (1) as described herein, characterized in that a height (h) of the spherical layer ranges preferably from ½ to ¼ of a diameter of the sphere.

In another preferred opinion, the antenna arrangement (1) as described herein, characterized in that the center point (M) of the sphere is located in the center of the spherical layer, seen in the primary emission direction of the antenna.

A In another preferred opinion, the antenna arrangement (1) as described herein, characterized in that the emission surface (5) is arranged in front of the central point (M), seen in the primary emission direction (A) of the antenna.

In another preferred opinion, the antenna arrangement (1) as described herein, characterized in that the clamping arrangement (11) comprises a sealing device (18).

In another preferred opinion, the antenna arrangement (1) as described herein, 00 characterized in that the sealing device (18) is arranged between the fastening apparatus (9) and the clamping flange (13) and acts upon the antenna fastening (7).

DETAILED DESCRIPTION OF THE INVENTION

Figure 1:
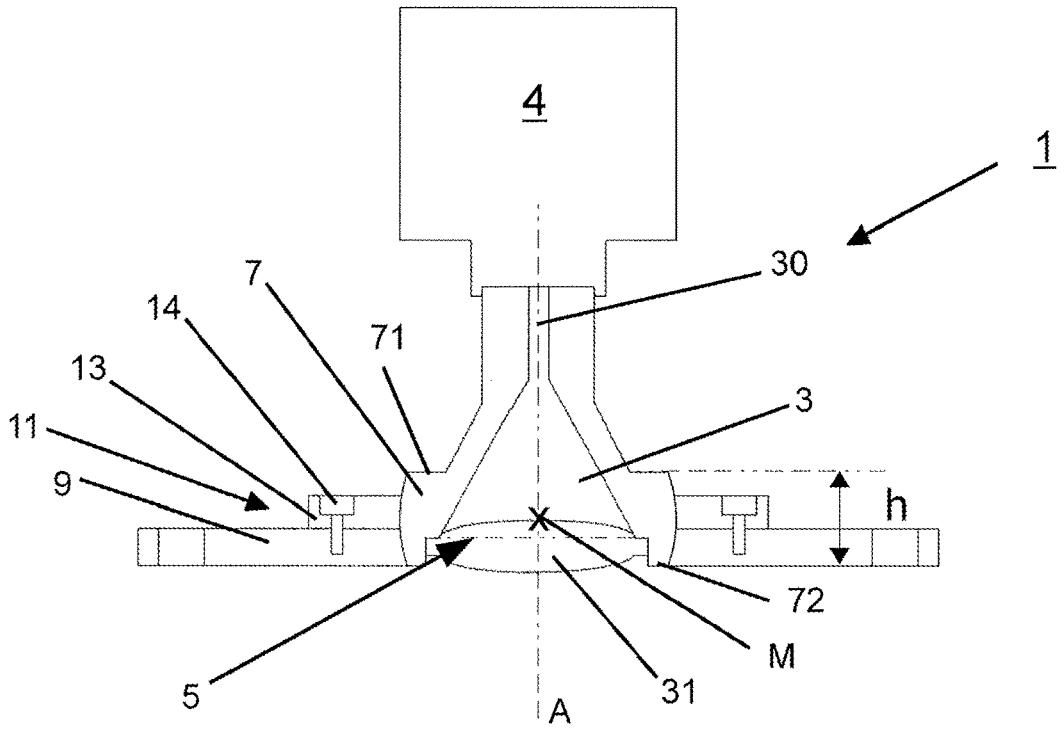
FIG. 1 is a line drawing evidencing a first exemplary embodiment of an antenna arrangement with a horn antenna.

An antenna arrangement according to the invention for a measuring device comprises an antenna with a front edge of the antenna, with an antenna fastening being provided for the pivotal fastening of the antenna at a fastening apparatus to arrange the antenna arrangement e.g., at a container or at a fastening, for example above a heap of bulk goods, and with the antenna arrangement being connected via a clamping arrangement to the fastening apparatus. According to the invention the antenna fastening is embodied as a spherical layer of a sphere, with the spherical layer comprising top and/or bottom surfaces extending parallel in reference to each other, showing the center of the sphere, and the emission surfaces being arranged inside the spherical layer.

In the present invention a surface, aligned perpendicular in reference to the primary direction of emission of the antenna, is considered the emission surface of the antenna, which geometrically limits the antenna towards the front in the primary direction of emission. In a horn antenna this represents, for example, the surface defined by a circumferential edge of the antenna horn, in a parabolic antenna the surface defined by the circumferential edge of the parabolic reflector, and in a planar antenna the level of the radiation elements.

A spherical layer in the sense of the present invention is a section of a sphere, limited by two planar and parallel surfaces, with both surfaces, hereinafter also called top surface or bottom surface, intersecting the sphere.

The above-mentioned embodiment allows the antenna of the antenna arrangement to pivot according to the invention in the fastening apparatus without here requiring additional space inside the container. This way it is possible to universally use the antenna arrangement according to the invention and particularly to mount it inside tubes or sockets which offer no lateral space for any pivoting of the antenna inside the container.

A particularly simple fastening of the antenna arrangement at the fastening apparatus develops when the clamping arrangement is formed by the fastening tube device and a clamping flange that is preferably embodied in two parts.

A particularly simple embodiment of such a clamping arrangement is yielded when the fastening apparatus and the clamping flange respectively show a recess for the antenna fastening, with its interior surface being embodied correspondingly, preferably at least sectionally in a conical manner or as segments of a sphere.

By a conical or spherical segment shaped embodiment, matching the respective opening in the fastening apparatus, which can be embodied for example as a clamping or threaded flange for fastening the antenna arrangement at a container, and the clamping flange it is achieved, that the antenna fastening is held in the clamping arrangement in a sealing and pivotal fashion and can be fixed thereby. In particular it is possible this way to implement an alignment of the antenna without detaching or loosening the fastening apparatus from the container.

In a preferred embodiment the antenna fastening comprises a limiting stop for limiting a maximum pivotal angle of the antenna.

In the present invention an angle is considered the pivotal angle of the antenna about which the antenna can be pivoted in reference to a perpendicular upon a surface of the fastening apparatus.

Such a limiting stop is preferably arranged at the outside of the antenna fastening and can be embodied, for example, as a circumferential brace extending preferably in the radial direction of the sphere. Such a limiting stop prevents particularly that the antenna fastening is moved beyond the maximally permitted pivoting angle. Such a maximally permitted pivoting angle may be predetermined, for example, due to the fact that in case of any pivoting beyond said angle, any sealing function is no longer ensured or the functionality of the antenna might be compromised. Such a compromising of the functionality of the antenna may be caused, for example in that a measuring signal emitted by the antenna would then no longer be sent into the inside of the container but in a direction of the fastening apparatus.

For merely practical considerations the maximum pivotal angle should not exceed 25°. In particular, it may be beneficial to limit the maximum pivotal angle to 15°, preferably to 10°.

In order to generate sufficient options for pivoting the antenna, particularly with regards to stability and sealing properties of the antenna arrangement, the height of the spherical layer preferably ranges from ½ to ¼ of a diameter of the sphere. Through such an embodiment, sufficient jacket surface of a spherical layer is provided which, in cooperation with the clamping arrangement, allows a pivoting motion and a sealing function.

The center of the sphere is preferably located centrally in the spherical layer, seen in the primary direction of emission of the antenna. This way, good clamping features of the antenna fastening in the clamping arrangement are ensured and good options for adjustments are provided.

The emission surface of the antenna is located preferably before the central point, seen in the primary direction of emission of the antenna, because this way it is achieved that the antenna, even in case of a pivoting in reference to the fastening apparatus, cannot emit into the material of the fastening apparatus but into the inside of the container.

In a further development of the antenna arrangement, the clamping arrangement comprises sealing devices which may be embodied as O-rings, for example. The sealing device may be arranged between the fastening apparatus and the clamping flange, for example, and act upon the antenna fastening such that by the sealing device both a sealing effect as well as a clamping effect is generated.

DETAILED DESCRIPTION OF THE FIGURES

FIG. 1 shows a first exemplary embodiment of an antenna arrangement 1 with an antenna 3, which is embodied according to the exemplary embodiment in FIG. 1 as a horn antenna.

An emission surface 5 of the horn antenna 3 is defined in the exemplary embodiment shown in FIG. 1 by a front edge of the antenna horn and aligned perpendicular in reference to a primary direction of emission A of the horn antenna 3. The horn antenna 3 is closed at the front by a lens 31, which however represents an optical component. At the rear, the horn antenna 3 is supplied via a hollow conductor 30 with a measuring signal generated in a measuring electronic 4. The hollow conductor may alternatively or additionally be filled partially or completely with a dielectric medium (for example PP or PTFE).

In the present exemplary embodiment the horn antenna 3 is embodied in one piece with an antenna fastening 7, which is embodied in a frontal area of the antenna 3 seen in the primary direction of emission A. The antenna fastening 7 is embodied in the form of a spherical layer.

A spherical layer is understood in the present application as a section of a sphere limited by two planar and parallel surfaces, with both surfaces, hereinafter also called top surface or bottom surface, intersecting the sphere.

The antenna fastening 7 is fastened via a clamping arrangement 11, which in the present exemplary embodiment is formed by the cooperation of a clamping flange 13 with a fastening apparatus 9. As shown in the present case, the fastening apparatus 9 can be embodied as a flange by which the antenna arrangement 1 can be fastened at a container. As an alternative to the embodiment as a clamping flange shown in FIG. 1, here an embodiment as a threaded flange or a welded flange is also possible.

In the present exemplary embodiment the clamping flange 13 is connected via clamping screws 14 to the fastening apparatus 9. By tightening the clamping screws 14, the clamping flange 13 is stressed in the direction of the fastening apparatus 9 and thus the antenna fastening 7 is fixed in reference thereto. Both the clamping flange 13 and the fastening apparatus 9 show recesses, embodied corresponding to the antenna fastening 7, in which they are arranged. For generating a clamping effect it is decisive that both the clamping flange 13 and the fastening apparatus 9 encompass the antenna fastening 7. In the present case, encompassing represents that a maximum diameter of a recess formed by the clamping flange 13 and the fastening apparatus 9 is inside the arrangement.

In the present exemplary embodiment it is embodied such that a center point M of the sphere underlying the spherical section of the antenna fastening 7 is located in the spherical layer of the antenna fastening 7. A height h of the antenna fastening amounts in the present exemplary embodiment to approximately ⅓ of a diameter of the underlying sphere.

Figure 2:
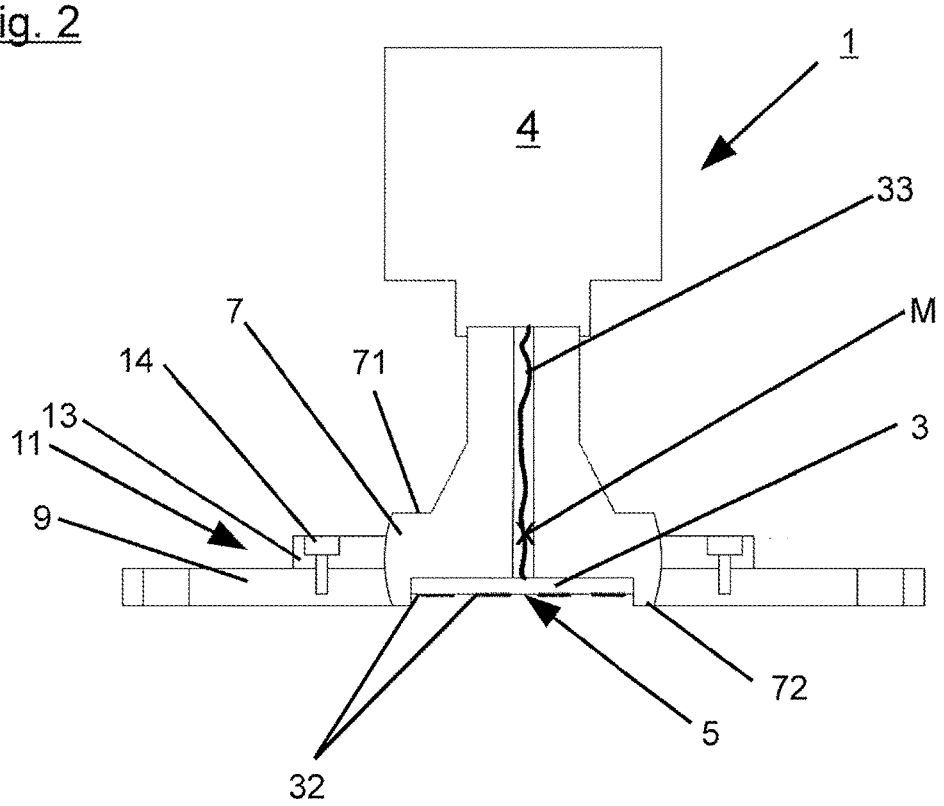
FIG. 2 is a line drawing evidencing a second exemplary embodiment of an antenna arrangement with a planar antenna.

FIG. 2 shows a second exemplary embodiment of an antenna arrangement 1, with the antenna 3 being embodied in the exemplary embodiment shown in FIG. 2 as a planar antenna comprising a plurality of patch elements 32 arranged side-by-side. Therefore, in the exemplary embodiment shown in FIG. 2, the emission surface 5 of the antenna 3 is defined by the level in which the patch elements 32 are arranged. Otherwise, the exemplary embodiment shown in FIG. 2 differs from the exemplary embodiment of FIG. 1 only such that in the respective embodiment of the antenna 3 as a planar antenna the feeding of the antenna 3 occurs not via a hollow conductor 30 but via a supply line 33, which connects the planar antenna 3 to the measuring electronic 4.

At this point it shall be mentioned that the exemplary embodiment shown in FIG. 2 also may comprise a cover of the planar antenna.

Figure 3:
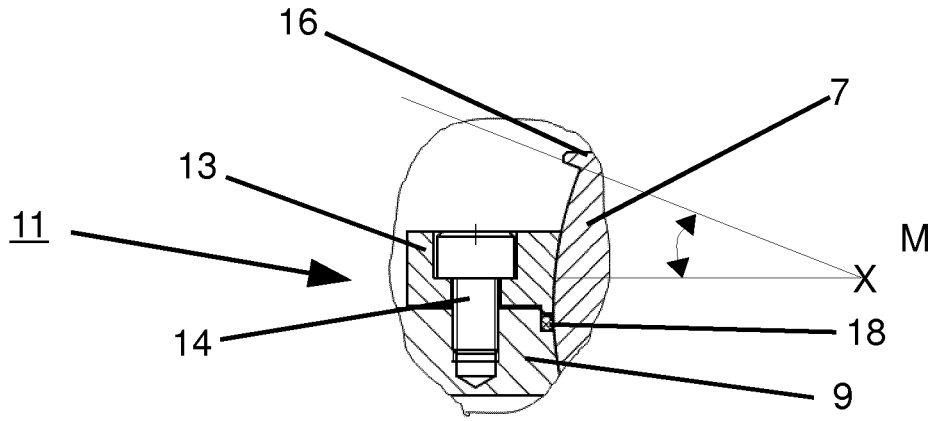
FIG. 3 is a line drawing evidencing an enlarged detail of FIGS. 1 and 2.

FIG. 3 shows an enlarged detail of FIGS. 1 and 2, in which the cooperation of the clamping flange 13 with the fastening apparatus 9 is shown in a particularly clear fashion, and the clamping effect upon the antenna fastener 7 yielded thereby. As already explained, the clamping flange 13 is connected via clamping screws 14 to the fastening apparatus 9 such that any pivoting of the antenna fastening 7 is possible without loosening the fastening apparatus 9 from the container. FIG. 3 additionally shows a limiting stop 16, which limits a maximum pivotal angle $\alpha$ of the antenna fastening 7 in reference to the clamping arrangement 11. In the present exemplary embodiment the limiting stop 16 is embodied as a circumferential brace, formed at the antenna fastening 7 and extending in the radial direction.

Further, in FIG. 3 a sealing device 18 is provided, not shown in FIGS. 1 and 2 for reasons of clear visibility, which is arranged between the clamping flange 13 and the fastening apparatus 9 such that a sealing and clamping effect is yielded upon the antenna fastening 7. The sealing device 18, in the present exemplary embodiment representing an O-ring, is arranged for this purpose at a circumferential step of the fastening apparatus 9 abutting the antenna fastening 7. The clamping flange 13 comprises a brace embodied corresponding to this circumferential step, applying additional pressure upon the sealing device 18 and thus compressing it such that improved sealing effects are yielded.

Figure 4:
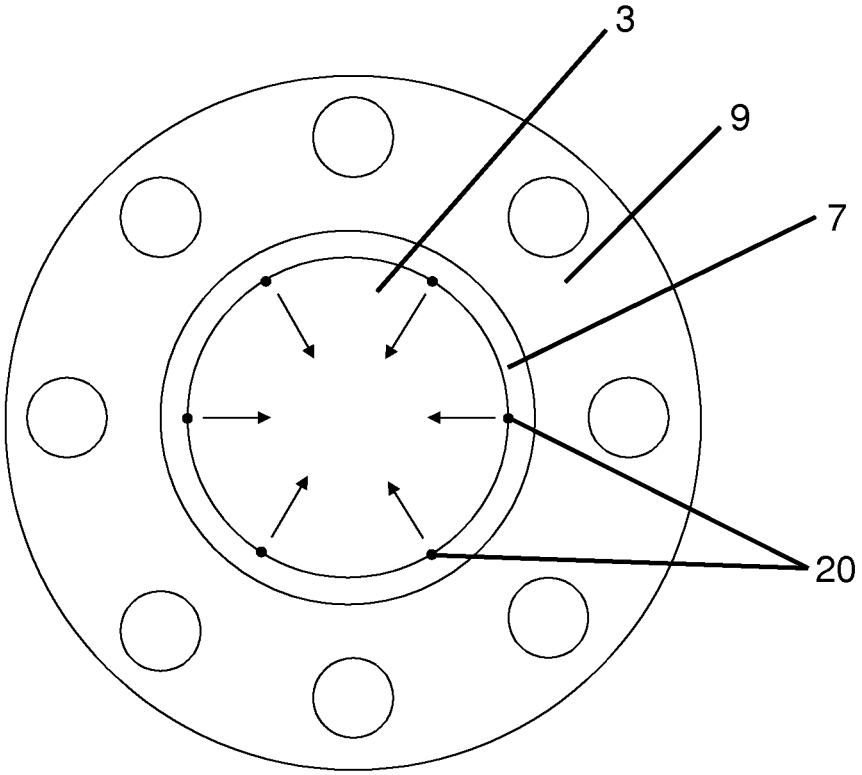
FIG. 4 is a line drawing evidencing a plan view from the bottom of the exemplary embodiment according to FIG. 2.

FIG. 4 shows a plan view from the bottom on the arrangement of FIG. 1 or 2. In the illustration shown in FIG. 4 the individual patch elements 32 of FIG. 2 are not shown for reasons of clarity. Instead, FIG. 4 shows rinsing nozzles 20, which are provided in the antenna fastening 7. The rinsing nozzles 20 are embodied and arranged such that they generate an air flow for cleaning and cooling the antenna 3, which is aligned from the rinsing nozzles 20 radially inwardly. In the present exemplary embodiment six individual rinsing nozzles 20 are shown, however embodiments with more or fewer rinsing nozzles or a circumferentially embodied rinsing channel may be possible as well for generating air flow passing over the antenna.

In the exemplary embodiment according to FIG. 1, the rinsing nozzles are arranged such that the lens 31 is cleaned from contaminants.

At this point it shall be pointed out that in addition to the exemplary embodiment shown in FIGS. 1 and 2 with an antenna and a planar antenna, other forms of antennas are also possible, particularly in combination with or without a lens, without here deviating from the fundamental idea of the present invention.

LIST OF REFERENCE NUMBERS

1 antenna arrangement
3 antenna

5 emission surface
7 antenna fastening
9 fastening apparatus
11 clamping arrangement
13 clamping flange
14 clamping screw
16 limiting stop
18 sealing device
20 rinsing nozzles
30 hollow conductor
31 lens
32 patch elements
71 top surface
72 bottom surface
M center point
h height
A primary direction of emission
α pivoting angle The references recited herein are incorporated herein in their entirety, particularly as they relate to teaching the level of ordinary skill in this art and for any disclosure necessary for the commoner understanding of the subject matter of the claimed invention. It will be clear to a person of ordinary skill in the art that the above embodiments may be altered or that insubstantial changes may be made without departing from the scope of the invention. Accordingly, the scope of the invention is determined by the scope of the following claims and their equitable equivalents.

We claim:

1. An antenna arrangement for a measuring device comprising an antenna, with an emission surface, an antenna fastening for the pivotal fastening of the antenna at a fastening apparatus, with the antenna fastening being connected via a clamping arrangement to the fastening apparatus, wherein the antenna fastening is embodied as a spherical layer of a sphere, with the spherical layer comprising top surfaces and bottom surfaces extending parallel in reference to each other, comprising the central point of the sphere, and the emission surface being arranged inside the spherical layer and wherein the antenna is a horn antenna or a planar antenna.

2. The antenna arrangement according to claim 1, wherein the clamping arrangement is formed by the fastening apparatus and a clamping flange.

3. The antenna arrangement according to claim 2, wherein the fastening apparatus comprises a first recess for the antenna fastening, with its interior surface being embodied at least sectionally in a conical fashion or showing the form of segments of a sphere.

4. The antenna arrangement according to claim 2, wherein the clamping flange comprises a second recess, with its interior surface being embodied at least sectionally in a conical fashion or as a segment of a sphere.

5. The antenna arrangement according to claim 2, wherein the sealing device is arranged between the fastening apparatus and the clamping flange and acts upon the antenna fastening.

6. The antenna arrangement according to claim 1, wherein the antenna fastening comprises a limiting stop for limiting a maximum pivotal angle.

7. The antenna arrangement according to claim 6, wherein the limiting stop is embodied as a brace extending in the radial direction of the sphere.

8. The antenna arrangement according to claim 6, wherein the maximum pivotal angle amounts to 25°.

9. The antenna arrangement according to claim 1, wherein a height of the spherical layer ranges from ½ to ¼ of a diameter of the sphere.

10. The antenna arrangement according to claim 1, wherein the center point of the sphere is located in the center of the spherical layer, seen in the primary emission direction of the antenna.

11. The antenna arrangement according to claim 10, wherein the emission surface is arranged in front of the central point, seen in the primary emission direction of the antenna.

12. The antenna arrangement according to claim 1, wherein the clamping arrangement comprises a sealing device.

* * * * *